US007943071B2

(12) United States Patent
Cho et al.

(10) Patent No.: US 7,943,071 B2
(45) Date of Patent: May 17, 2011

(54) POLYETHYLENE TEREPHTHALATE FILAMENT HAVING HIGH TENACITY FOR INDUSTRIAL USE

(75) Inventors: Dae-Hwan Cho, Kyonggi-do (KR); Kyu-Chan Han, Kyonggi-do (KR); Dong-Seok Shim, Kyonggi-do (KR)

(73) Assignee: Hyosung Corporation, Kyonggi-do (KR)

( * ) Notice: Subject to any disclaimer, the term of this patent is extended or adjusted under 35 U.S.C. 154(b) by 0 days.

(21) Appl. No.: 12/591,394

(22) Filed: Nov. 18, 2009

(65) Prior Publication Data

US 2010/0098945 A1 Apr. 22, 2010

Related U.S. Application Data

(62) Division of application No. 11/433,532, filed on May 15, 2006, now abandoned.

(30) Foreign Application Priority Data

Apr. 14, 2006 (KR) ..... 10-2006-0033877

(51) Int. Cl.
*B29C 49/08* (2006.01)

(52) U.S. Cl. ..... 264/210.7; 264/210.8; 264/290.7; 428/364; 428/395

(58) Field of Classification Search ..... None
See application file for complete search history.

(56) References Cited

U.S. PATENT DOCUMENTS

| | | | | | |
|---|---|---|---|---|---|
| 3,216,187 | A | * | 11/1965 | Chantry et al. | 428/401 |
| 3,790,995 | A | * | 2/1974 | Martin et al. | 28/245 |
| 3,995,004 | A | * | 11/1976 | Heinrich et al. | 264/151 |
| 4,021,520 | A | * | 5/1977 | Heinrich et al. | 264/103 |
| 4,324,371 | A | * | 4/1982 | Shimizu | 242/153 |
| 4,491,657 | A | | 1/1985 | Saito et al. | |
| 4,610,060 | A | * | 9/1986 | Phillips et al. | 28/246 |
| 4,827,999 | A | * | 5/1989 | Yabuki et al. | 152/451 |
| 4,975,326 | A | | 12/1990 | Buyalos et al. | |
| 5,033,523 | A | | 7/1991 | Buyalos et al. | |
| 5,558,935 | A | | 9/1996 | Tanaka et al. | |
| 5,609,888 | A | * | 3/1997 | Uda et al. | 425/66 |
| 5,713,601 | A | | 2/1998 | Bonigk | |

(Continued)

FOREIGN PATENT DOCUMENTS

| | | | |
|---|---|---|---|
| EP | 1 054 084 | A | 11/2000 |
| JP | 11-124725 | | 5/1999 |
| JP | 11 124726 | A | 5/1999 |
| JP | 11-158726 | | 6/1999 |
| JP | 2002-371430 | | 12/2002 |
| WO | 01/36724 | | 5/2001 |

OTHER PUBLICATIONS

Huang et al, "High Performance Poly(ethylene terephthalate) Fibre Properties Achieved via High Speed Spinning with a Modified Liquid Isothermal Bath Process", Polymer, Elsevier Science Publishers B.V., GB, vol. 38, No. 5, Jan. 1, 1997, pp. 1101-1110; XP004034296.
Geller, "Technological Aspects of Orientational Strengthening of Poly(ethylene terephthalate). Modern Schemes for Production of High-strength Polyester Fibres", Fibre Chemistry, Springer, New York, NY, vol. 33, No. 5, Oct. 1, 2001, pp. 353-363, XP001087276.

(Continued)

*Primary Examiner* — Jill Gray
(74) *Attorney, Agent, or Firm* — Nixon & Vanderhye P.C.

(57) ABSTRACT

A polyethylene terephthalate monofilament obtained by spinning a polyethylene terephthalate chip having an intrinsic viscosity of 0.8 to 1.3, which gives a stress-strain curve exhibiting an elongation of less than 2.5% at an initial stress of 2.0 g/d, with an initial modulus value of 80 to 160 g/d, an elongation of 7.5% or less in a stress range of from 2.0 g/d to 9.0 g/d, and an elongation of at least 2.0% or more in a stress range of from 10.0 g/d to the point of break, is provided.

2 Claims, 2 Drawing Sheets

U.S. PATENT DOCUMENTS

| | | | | |
|---|---|---|---|---|
| 6,228,488 | B1 | 5/2001 | Tang et al. | |
| 6,780,358 | B2 * | 8/2004 | Jen | 264/103 |
| 2004/0012115 | A1 * | 1/2004 | Minagawa et al. | 264/210.7 |
| 2004/0048065 | A1 * | 3/2004 | Jen | 428/373 |
| 2008/0317984 | A1 * | 12/2008 | Yamashita et al. | 428/34.8 |
| 2010/0098945 | A1 * | 4/2010 | Cho et al. | 428/364 |

OTHER PUBLICATIONS

Gang Wu et al, "The Effect of a Liquid Isothermal Bath in the Threadline on the Structure and Properties of Poly(ethylene terephthalate) Fibers", Journal of Applied Polymer Science, vol. 55, No. 9, Feb. 28, 1995; XP002538698, p. 1276.

* cited by examiner

POLYETHYLENE TEREPHTHALATE FILAMENT HAVING HIGH TENACITY FOR INDUSTRIAL USE

CROSS REFERENCE TO RELATED APPLICATION

This application is a divisional of application Ser. No. 11/433,532 filed May 15, 2006, now abandoned which in turn claims priority of Korean application Serial No. 10-2006-0033877 filed Apr. 14, 2006, the contents of each of which are incorporated herein.

BACKGROUND OF THE INVENTION

1. Field of the Invention

The present invention relates to a polyethylene terephthalate monofilament fiber which gives a stress-strain curve exhibiting an elongation of at least 2.0% or more in a stress range of from 10.0 g/d to the point of break. The monofilament fiber according to the invention is characterized by high tenacity, high modulus and low strain, and thus can be used for the production of high tenacity polyester fiber for industrial use, which is used as the material for industrial rope, reinforcement material for construction, webbing or seatbelt.

2. Description of the Related Art

As a useful conventional method for enhancing the tenacity of polyester fibers for industrial use, there is available a method of melting a high viscosity chip having an intrinsic viscosity of 1.0 or greater, heating the melt polymer to a temperature of 310° C. to sufficiently melt the polymer, solidifying the polymer at a quenching temperature of 15 to 18° C. in a hood of 280 mm long at a hood temperature of 340° C., winding the polymer at low speed on godet rollers to obtain undrawn yarn, drawing the undrawn yarn directly in a first step and a second step up to a draw ratio of 6.0, and then relaxing the drawn yarn to finally wind the drawn yarn. Here, the characteristic of high tenacity is obtained by decreasing the degree of orientation of the undrawn yarn through low speed winding, and by drawing the undrawn yarn at a high draw ratio. The polyester yarn produced by the conventional method as described above has a modulus value of 60 g/d to 100 g/d, a stress of 9.5 g/d or less, and an elongation at break of 13 to 18%.

When the draw ratio is increased to obtain a fiber of higher tenacity using such conventional spinning technology, a processing problem of yarn break during spinning and fluffing frequently occur, resulting in poor post-processing properties. Therefore, the conventional technology leads to an increase in the production costs and lowering of the product quality, and thus it is difficult to obtain high tenacity yarns therefrom.

SUMMARY OF THE INVENTION

Accordingly, it is an object of the present invention to provide a polyethylene terephthalate monofilament fiber which has a stress-strain profile exhibiting an elongation of at least 2.0% or more in a stress range of from 10.0 g/d to the point of break.

The fiber according to the invention is produced by a method of adjusting the areas of contact between the yarn and the godet rollers, on which initial drawing and secondary drawing are performed, so as to increase the draw ratio, thus enabling drawing at a draw ratio of 6.5, which is higher than the conventionally achieved draw ratio of 6.0.

DESCRIPTION OF THE PREFERRED EMBODIMENTS

Figure 1:
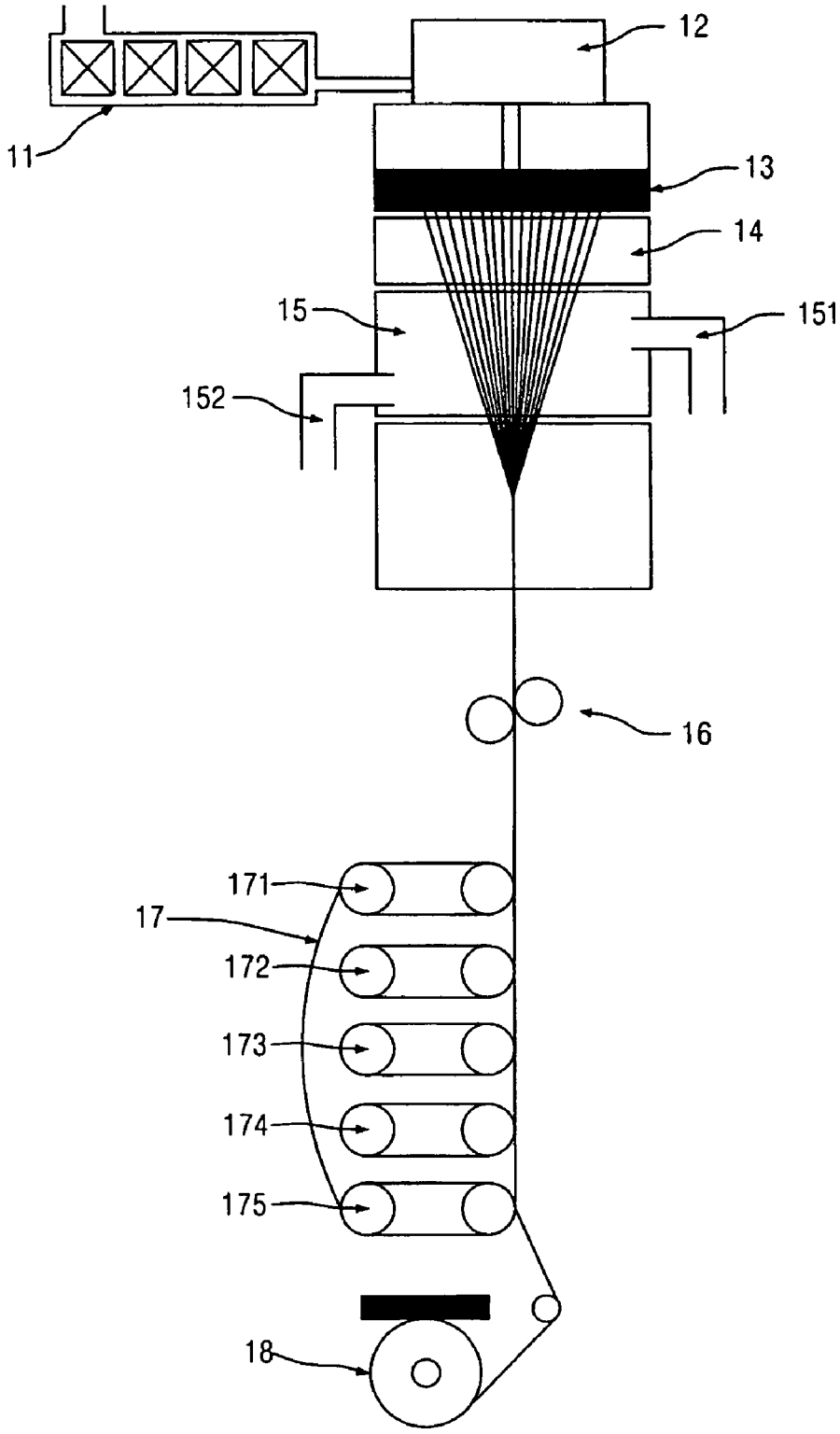
FIG. 1 is a schematic diagram illustrating the production process for the polyethylene terephthalate filament according to the present invention.

According to a preferred embodiment of the present invention, a polyethylene terephthalate monofilament having an intrinsic viscosity of 0.8 to 1.3 gives a stress-strain curve exhibiting an elongation of less than 2.5% at an initial stress of 2.0 g/d, with an initial modulus value of 80 to 160 g/d, an elongation of 7.5% or less in a stress range of from 2.0 g/d to 9.0 g/d, and an elongation of at least 2.0% or more in a stress range of from 10.0 g/d to the point of break.

According to another embodiment of the invention, the polyethylene terephthalate monofilament has a linear density of 3 to 30 denier.

According to another embodiment of the invention, a multifilament consisting of an aggregate of 50 to 40,000 polyethylene terephthalate monofilaments is provided.

According to another embodiment of the invention, a multifilament consisting of an aggregate of 192 or 384 polyethylene terephthalate monofilaments is provided.

According to another embodiment of the invention, the multifilament has a stress of 10 to 13 g/d.

According to another embodiment of the invention, the multifilament has an elongation at break of 9.5 to 13.5%.

The invention provides industrial products such as industrial rope, reinforcement material for construction, webbing or seatbelt, all of which comprise the multifilament.

According to the invention, in the case of a high tenacity polyethylene terephthalate yarn used for industrial rope, reinforcement material for construction, webbing or seatbelt, the stress-strain curve of the polyethylene terephthalate monofilament is adjusted for the purpose of minimizing the initial elongation against the impact occurring initially under an external force. The stress-strain curve of the polyethylene terephthalate monofilament measured at ambient temperature preferably exhibits an elongation of less than 2.5% at an initial stress of 2.0 g/d, with an initial modulus value of 80 to 160 g/d, an elongation of 7.5% or less in a stress range of from 2.0 g/d to 9.0 g/d, and an elongation of at least 2.0% or more in a stress range of from 10.0 g/d to the point of break.

In the case of using as industrial rope or reinforcement material for construction, the polyethylene terephthalate monofilament should have high initial modulus and less drawing under initially applied force, so as to prevent sudden deformation. In order to obtain such material, the polyethylene terephthalate monofilament of the invention preferably has an elongation of less than 2.5% at an initial stress of 2.0 g/d, and an initial modulus value of 80 to 160 g/d. If the monofilament has an elongation of 2.5% or greater at an initial stress of 2.0 g/d, or has a lower modulus value, sudden deformation of the monofilament makes it difficult to obtain a stress-supporting or reinforcing effect.

Furthermore, the polyethylene terephthalate monofilament used for the production of such material has preferably an elongation of 7.5% or less in the stress range of from 2.0 g/d to 9.0 g/d. When the monofilament has an elongation of 7.5% or more, the dimensional stability of the monofilament is decreased, resulting in large deformation and the monofilament can be hardly used as industrial reinforcement material or rope.

In addition, for the purpose of minimizing the storage space through miniaturization of industrial products such as industrial rope, reinforcement material for construction, webbing or seatbelt, it is preferable for the polyethylene terephthalate monofilament of the invention to draw with an elongation of at least 2.0% or more in the stress range of from 10.0 g/d to the point of break. This is because, when the monofilament has an elongation of less than 2.0% from 10.0 g/d to the point of break, the ability of the filament for absorbing the maximum tensile load is insufficient, and thus, industrial products produced from small amounts of woven yarns would have insufficient tensile strength.

The present invention will be described in detail with reference to the attached drawings.

In FIG. 1, a polyester chip having an intrinsic viscosity in the range of 0.80 to 1.30 is melted in an extruder 11, in which the temperature condition is set lower. Here, the temperature of the melted polymer is set to 290 to 305° C., and heat is applied to maintain the temperature of the gear pump 12. At this time, the temperature of the gear pump 12 is adjusted to be low, so that the temperature of the polymer passing through the gear pump 12 is maintained at 295 to 310° C. Thermal decomposition due to exotherm or high temperature as a result of the temperature adjustment should be suppressed as far as possible, so that the characteristic properties of the polymer itself are not lost. The diameter of the nozzle holes of a spinneret 13 is set to 0.5 to 0.8ϕ, while the ratio of the length to the diameter (L/D) of a hole of the spinneret 13 is set to 2 to 3, in order to maintain the spinning draft at a constant level, and to impart high stretchability to the polymer on the godet roller. The length of a hood heater 14 is extended to 320 to 500 mm, and the temperature of the hood heater 14 is raised to 350 to 400° C., so that an atmosphere allowing the spun yarn to have a non-crystalline and non-oriented structure is rendered inside the hood. To this non-crystalline, non-oriented yarn thus formed, air at a temperature of 15 to 18° C. is supplied through a high-throughput air supplying inlet 151 and discharged through an air outlet 152 in the cooling zone 15, thereby allowing rapid quenching of the non-crystalline, non-oriented yarn. Here, the amount of air supplied is set to 80 to 110 mmAq, while the amount of air discharged is set to 90 to 120 mmAq. The non-crystalline, non-oriented yarn which has been solidified is subjected to oiling to an appropriate extent by using an oiling apparatus 16. Thereafter, a guide of a specific form is applied to the second godet rollers (GR) 172 so as to adjust the area of contact between the multifilament yarn and the roller surface of the second GR to about 1,000 to 15,000 $mm^2$, so that primary drawing is performed smoothly at the second GR 172 and the third GR 173. Then, a guide is applied prior to the third GR 173 in order to maintain the spread of the yarn constant on the third GR 173, so as to adjust the area of contact between the multifilament yarn and the roller surface of the third GR 173 to about 5,000 to 25,000 $mm^2$, so that secondary drawing is performed smoothly on the third GR 173 and the fourth GR 174. The multifilament is relaxed between the fourth GR 174 and the fifth GR 175 and then wound up on a winder 18.

Figure 2:
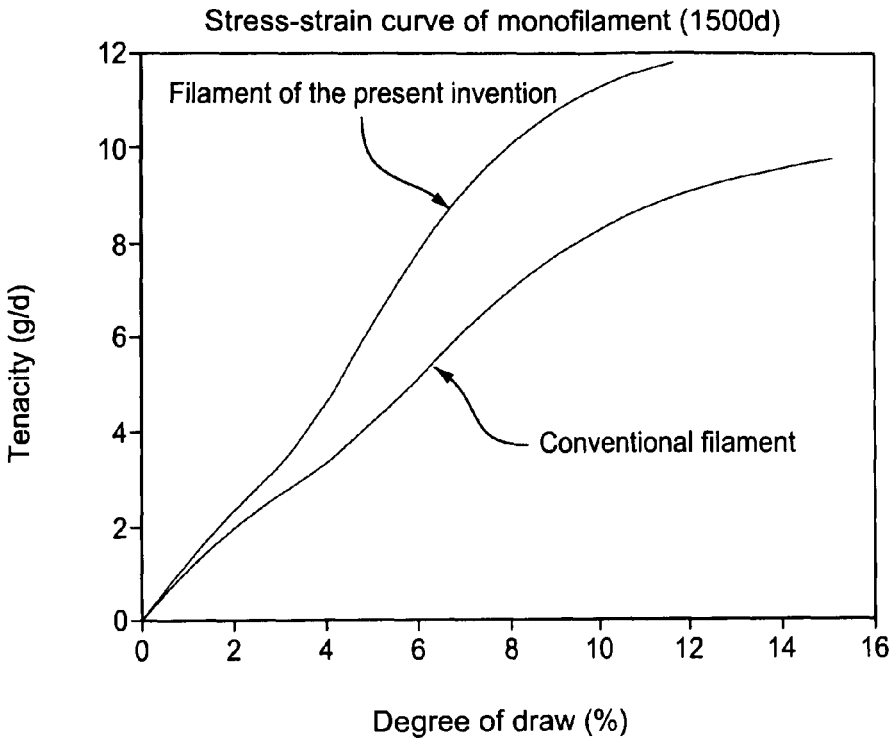
FIG. 2 is a graph showing the stress-strain-curves for monofilaments of the 1500D polyethylene terephthalate filament of the present invention and a conventional 1500D polyethylene terephthalate filament.

FIG. 2 is a graph showing the stress-strain curves for the monofilaments of the 1500D polyethylene terephthalate filament of the present invention and a conventional 1500D polyethylene terephthalate filament.

Figure 3:
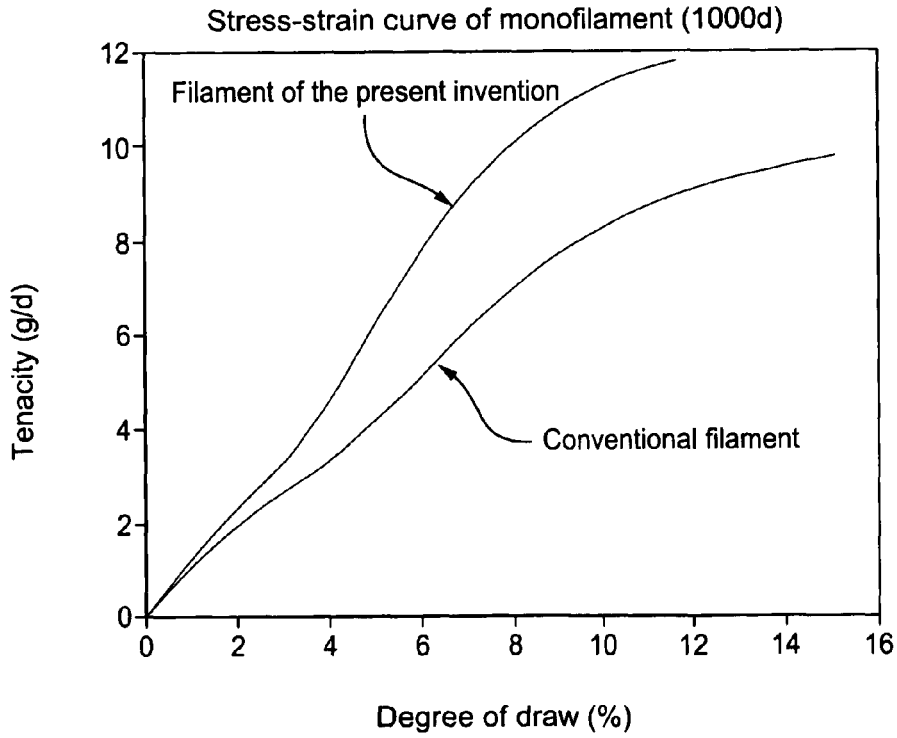
FIG. 3 is a graph showing the stress-strain curves for monofilaments of the 1000D polyethylene terephthalate filament of the present invention and a conventional 1000D polyethylene terephthalate filament.

FIG. 3 is a graph showing the stress-strain curves for the monofilaments of the 1000D polyethylene terephthalate filament of the present invention and a conventional 1000D polyethylene terephthalate filament.

According to the present invention, the stress-strain curve of a polyethylene terephthalate monofilament can be adjusted to minimize the initial elongation of the industrial high tenacity yarn caused by the impact initially applied by external force. The polyethylene terephthalate monofilament of the invention may result in a stress-strain curve which exhibits an elongation of less than 2.5% at an initial stress of 2.0 g/d, with an initial modulus value of 80 to 160 g/d, an elongation of 7.5% or less in a stress range of from 2.0 g/d to 9.0 g/d, and an elongation of at least 2.0% or more in a stress range of from 10.0 g/d to the point of break.

According to the invention, the process which is used for obtaining such stress-strain curve comprises the steps of rendering an atmosphere in the hood such that a polyethylene terephthalate monofilament can have a maximally non-crystalline and non-oriented structure while passing through the hood heater 14, and rapidly quenching the non-crystalline, non-oriented yarn thus formed in the cooling zone 15 to maintain the non-crystalline and non-oriented state as far as possible, so as to allow operation with a high draw ratio.

The factor which highly affects the stress-strain curve for the monofilament of the invention is the areas of contact between the yarn and the godet rollers, on which the initial primary drawing and secondary drawing occur. As the contact areas are adjusted, a preferable stress-strain curve for the monofilament of the invention is obtained. The polyethylene terephthalate filament which has passed through the cooling zone 15 has constant contact areas with the surfaces of the second GR 172 and the third GR 173, which highly affect the initial primary drawing and the secondary drawing. The area of contact between the multifilament yarns with the surface of the godet rollers used for the initial primary drawing is preferably 4,000 to 8,000 $mm^2$, while the area of contact between the multifilament yarns with the surface of the godet rollers used for the secondary drawing is preferably 14,000 to 18,000 $mm^2$. When the area of contact between the multifilament yarns and the surface of the godet rollers used for the initial primary drawing is less than 4,000 $mm^2$, or when the area of contact between the multifilament yarn and the surface of the godet rollers used for the secondary drawing is less than 14,000 $mm^2$, uniform heat transfer is not achieved between the multifilaments. Furthermore, non-uniformity of the flowing agent causes reduction in the stretchability, and it is difficult to obtain a preferable stress-strain curve for the monofilament of the invention. On the contrary, when the area of contact between the multifilament yarn and the surface of the godet rollers used for the initial primary drawing is larger than 8,000 $mm^2$, or when the area of contact between the multifilament yarn and the surface of the godet rollers used for the secondary drawing is larger than 18,000 $mm^2$, there are problems such as generation of fluff due to contact between filaments, and tar generation. Therefore, the contact areas should be suitably adjusted in order for the non-crystalline, non-oriented monofilament to obtain the maximum stretchability.

There are many factors affecting the area of contact between multifilament yarn and godet roller surface. The area of contact increases proportionally to the number of winding (number of turn) of the filament wound on the godet rollers for drawing. That is, the number of winding can be adjusted to adjust the area of contact. Another important factor is that a guide having a certain form is applied to maintain the spread of the yarn between the godet rollers constant, so that the yarn width of the yarn wound on the godet rollers can be adjusted. For example, if the guide takes a form of a narrow V-shaped groove, the yarn width is reduced, and eventually the contact area is reduced. If the guide takes a flat form, the yarn width is increased, and the contact area is increased. Another factor for adjusting the contact area is the drawing tension of the roller, drawing temperature, amount of flowing agent, and the like.

A preferable stress-strain-curve of the monofilament of the invention can be obtained by adjusting the area of contact of the multifilament yarn with the surface of the second GR 172, which largely affects the primary drawing, to 4,000 to 8,000 $mm^2$, while adjusting the area of contact of the multifilament yarn with the surface of the third GR 173, which are the godet rollers used for the secondary drawing, to 14,000 to 18,000 $mm^2$, by organically combining various factors.

The polyethylene terephthalate multifilament obtained by aggregating 50 to 40,000 polyethylene terephthalate monofilaments produced through such process, has good spinnability and thus is advantageous in the aspects of external appearance and fluffing. Also, the polyethylene terephthalate multifilament has a stress of 10 to 13 g/d, a modulus of 110 to 140 g/d, and an elongation at break of 9.5 to 13.5% or less, and thus can be widely used as an industrial polyester fiber which is useful for industrial rope, reinforcement material for construction, webbing and seatbelt.

The property evaluations in the following Examples and Comparative Examples were performed as follows.

1) Intrinsic viscosity (I.V.)

0.1 g of a sample is dissolved in a reagent comprising a mixture of phenol and 1,1,2,2-tetrachloroethaanol at a weight ratio of 6:4 at 90° C. for 90 minutes, and then the solution is transferred to an Ubbelohde viscometer, which is then maintained in a constant temperature bath at 30° C. for 10 minutes. The time in seconds taken by the solution in dropping is measured by using a viscometer and an aspirator. The time in seconds taken by the solvent in dropping is also measured by the same method as described above, and the R.V. value and the I.V. value are calculated according to the following equations:

R.V.=Time in seconds taken by the sample in dropping/Time in seconds taken by the solvent in dropping $$I.V.=\tfrac{1}{4}\times[(R.V.-1)/C]+\tfrac{3}{4}\times(\ln R.V./C)$$

In the above equation, C represents the concentration (g/100 ml) of the sample in the solution.

2) Measurement of Modulus, Strength and Elongation of Multifilament

The original yarn is left to stand under standard conditions, that is, in a constant-temperature and constant humidity chamber at a temperature of 25° C. and at a relative humidity of 65% for 24 hours, and then a sample is subjected to the measurement according to the method of ASTM 2256 using a tensile test machine. The properties of the multifilament are measured by using an average of 8 values, excepting one minimum value and one maximum value, from 10 values obtained from measurement of 10 multifilaments. The initial modulus indicates the gradient of the stress-strain curve before the yield point.

3) Tenacity (g/d), Elongation at Specific Load (%) and modulus (g/d) of monofilament Ten monofilaments are extracted from an original yarn (multifilament) which has been left to stand at a temperature of 25° C. and at a relative humidity of 65 RH % for 24 hours. Subsequently, a load (weak, monodenier×60 (mg)) defined according to the denier number was applied to a sample having a length of 20 mm by using a monofilament tensile test machine Vibrojet 2000 manufactured by Lenzing Gruppe, and then the initial load was measured at a tensile rate of 20 mm/min. The properties of the monofilament are measured by using an average of 8 values, excepting one minimum value and one maximum value, from 10 measured values. The initial modulus indicates the gradient of the stress-strain curve before the yield point.

4) External Appearance

The original yarn which is wound on a winder in a cake form is observed with naked eyes for 5 minutes using a Stroboscope, for the presence or absence of fluff.

5) Number of Fluff

The original yarn is measured along a length of 30,000 m by using a Pilot Warper testing machine at a yarn speed of 300 to 500 m/min and at a sensitivity of 2.5 to 4.5 levels (relative value).

6) Processability

The frequency of yarn break occurring only on the godet rollers is determined by observing the original yarn at a single position for 24 hours.

7) Area of Contact Between Yarn and Godet Roller Surface

The yarn width at the first turning point is determined by photographic measurement, and the yarn width at the final turning point is determined in the same manner, thus to obtain an average of the two values. The contact area is calculated by the equation:

Contact area=average yarn width×number of turns×radius of godet roller×2 (for a pair of godet rollers)

EXAMPLES

Examples 1 to 3

A polyester chip having an intrinsic viscosity of 1.00 was melted, and the melt polymer was extruded through a nozzle having 192 orifices, each orifice having a diameter of 0.6 mm and a ratio of length and diameter (L/D) of 3.

The extruded polymer was quenched with air at 15° C., gathered and oiled. Subsequently, the filament was subjected to winding 5 turns at the second godet rollers (primary drawing point) at 100° C., and 7 turns at the third godet rollers (secondary drawing point) at 125° C., with the ratio of the primary draw at the second godet rollers and the third godet rollers to the secondary draw at the third godet rollers and the fourth godet rollers being 75%:25%. A guide in a flat form having a 4 mm-wide groove was applied before the second godet rollers and the third godet rollers. The speed of the fourth godet rollers was set at 2700 m/min. Thus, filaments of 1500 denier each were spun and drawn under the spinning conditions presented in Table 1. The results are given in Table 5.

Comparative Example 1

A filament was produced in the same manner as in Examples 1 to 3 described above, except that a guide in a flat form having a 6.5 mm-wide groove was applied before the second and third godet rollers, and the filament was subjected to winding 5 turns at the second godet rollers and 7 turns at the third godet rollers.

Comparative Example 2

A filament was produced in the same manner as in Comparative Example 1, except that a guide in a flat form having a narrow V-shaped groove (width of the guide groove. being 2.5 mm) was applied before the second and third godet rollers, and the filament was subjected to winding 6 turns at the second godet rollers and 8 turns at the third godet rollers.

TABLE 1

| Condition | Example 1 | Example 2 | Example 3 | Comp. Ex. 1 | Comp. Ex. 2 |
|---|---|---|---|---|---|
| Temperature of melt polymer (° C.) | 295 | 297 | 300 | 285 | 310 |
| Temperature of polymer in gear pump (° C.) | 300 | 305 | 310 | 285 | 315 |
| Length of hood heater (mm) | 320 | 380 | 440 | 250 | 550 |
| Temperature of hood heater (° C.) | 350 | 375 | 400 | 320 | 410 |
| Pressure of quenching air (mmAq) | 90/100 | 110/120 | 110/120 | 50/60 | 130/140 |
| Area of contact with $2^{nd}$ GR ($mm^2$) | 6500 | 6000 | 5500 | 11000 | 3500 |
| Area of contact with $3^{rd}$ GR ($mm^2$) | 15500 | 14500 | 13500 | 20000 | 12000 |
| Total draw ratio | 6.4 | 6.5 | 6.55 | 6.0 | 6.3 |
| Denier | 1510 | 1508 | 1518 | 1509 | 1516 |

Examples 4 to 6

A polyester chip having an intrinsic viscosity of 1.05 was melted, and the melt polymer was extruded through a nozzle having 192 orifices, each orifice having a diameter of 0.6 mm and a ratio of length and diameter (L/D) of 3. The extruded polymer was quenched with air at 15° C., gathered and oiled. Subsequently, the filament was subjected to winding 6 turns at the second godet rollers (primary drawing point) at 100° C., and 7 turns at the third godet rollers (secondary drawing point) at 125° C., with the ratio of the primary draw at the second godet rollers and the third godet rollers to the secondary draw at the third godet rollers and the fourth godet rollers being 73%:27%. A guide in a flat form having a 4 mm-wide groove was applied before the second godet rollers and the third godet rollers. The speed of the fourth godet rollers was set at 2700 m/min. Thus, filaments of 1500 denier each were spun and drawn under the spinning conditions presented in Table 2. The results are given in Table 5.

Comparative Example 3

A filament was produced in the same manner as in Examples 4 to 6 described above, except that a guide in a flat form having a 6.5 mm-wide groove was applied before the second and third godet rollers, and the filament was subjected to winding 5 turns at the second godet rollers and 7 turns at the third godet rollers.

Comparative Example 4

A filament was produced in the same manner as in Comparative Example 3, except that a guide having a narrow V-shaped groove (width of the guide groove being 2.5 mm) was applied before the second and third godet rollers, and the filament was subjected to winding 6 turns at the second godet rollers and 8 turns at the third godet rollers.

TABLE 2

| Condition | Example 4 | Example 5 | Example 6 | Comp. Ex. 3 | Comp. Ex. 4 |
|---|---|---|---|---|---|
| Temperature of melt polymer (° C.) | 298 | 300 | 302 | 299 | 320 |
| Temperature of polymer in gear pump (° C.) | 305 | 308 | 310 | 300 | 315 |
| Length of hood heater (mm) | 320 | 380 | 440 | 250 | 550 |
| Temperature of hood heater (° C.) | 350 | 375 | 400 | 320 | 440 |
| Pressure of quenching air (mmAq) | 90/100 | 110/120 | 110/120 | 40/50 | 130/140 |
| Area of contact with $2^{nd}$ GR ($mm^2$) | 7000 | 6500 | 6000 | 11500 | 3800 |
| Area of contact with $3^{rd}$ GR ($mm^2$) | 16000 | 15000 | 14000 | 21000 | 12500 |
| Total draw ratio | 6.3 | 6.4 | 6.5 | 5.9 | 6.2 |
| Denier | 1520 | 1514 | 1525 | 1511 | 1517 |

Examples 7 to 9

A polyester chip having an intrinsic viscosity of 1.00 was melted, and the melt polymer was extruded through a nozzle having 192 orifices, each orifice having a diameter of 0.6 mm and a ratio of length and diameter (L/D) of 3. The extruded polymer was quenched with air at 15° C., gathered and oiled. Subsequently, the filament was subjected to winding 5 turns at the second godet rollers (primary drawing point) at 100° C., and 8 turns at a third godet rollers (secondary drawing point) at 125° C., with the ratio of the primary draw at the second godet rollers and the third godet rollers to the secondary draw at the third godet rollers and the fourth godet rollers being 75%:25%. A guide in a flat form having a 4 mm-wide groove was applied before the second godet rollers and the third godet rollers. The speed of the fourth godet rollers was set at 3000 m/min. Thus, filaments of 1000 denier each were spun and drawn under the spinning conditions presented in Table 3. The results are given in Table 5.

Comparative Example 5

A filament was produced in the same manner as in Examples 7 to 9 described above, except that a guide in a flat form having a 6.5 mm-wide groove was applied before the second and third godet rollers, and the filament was subjected to winding 5 turns at the second godet rollers and 8 turns at the third godet rollers.

Comparative Example 6

A filament was produced in the same manner as in Comparative Example 5, except that a guide having a narrow V-shaped groove (width of the guide groove being 2.5 mm) was applied before the second and third godet rollers, and the filament was subjected to winding 7 turns at the second godet rollers and 9 turns at the third godet rollers.

Examples 10 to 12

A polyester chip having an intrinsic viscosity of 1.05 was melted, and the melt polymer was extruded through a nozzle having 192 orifices, each orifice having a diameter of 0.6 mm and a ratio of length and diameter (L/D) of 3. The extruded polymer was quenched with air at 15° C., gathered and oiled. Subsequently, the filament was subjected to winding 5 turns at the second godet rollers (primary drawing point) at 100° C., and 8 turns at the third godet rollers (secondary drawing point) at 125° C., with the ratio of the primary draw at the second godet rollers and the third godet rollers to the secondary draw at the third godet rollers and the fourth godet rollers being 70%:30%. A guide in a flat form having a 4 mm-wide groove was applied before the second godet rollers and the third godet rollers. The speed of the fourth godet rollers was set at 3000 m/min. Thus, filaments of 1000 denier each were spun and drawn under the spinning conditions presented in Table 4. The results are given in Table 5.

Comparative Example 7

A filament was produced in the same manner as in Examples 10 to 11 described above, except that a guide in a wide flat form having a 6.5 mm-wide groove was applied before the second and third godet rollers, and the filament was subjected to winding 5 turns at the second godet rollers and 8 turns at the third godet rollers.

Comparative Example 8

A filament was produced in the same manner as in Comparative Example 7, except that a guide having a narrow V-shaped groove (width of the guide groove being 2.5 mm) was applied before the second and third godet rollers, and the filament was subjected to winding 4 turns at the second godet rollers and 9 turns at the third godet rollers.

TABLE 3

| Condition | Example 7 | Example 8 | Example 9 | Comp. Ex. 5 | Comp. Ex. 6 |
|---|---|---|---|---|---|
| Temperature of melt polymer (° C.) | 295 | 297 | 300 | 285 | 310 |
| Temperature of polymer in gear pump (° C.) | 300 | 305 | 310 | 285 | 315 |
| Length of hood heater (mm) | 320 | 380 | 400 | 250 | 550 |
| Temperature of hood heater (° C.) | 350 | 375 | 400 | 320 | 440 |
| Pressure of quenching air (mmAq) | 90/100 | 110/120 | 110/120 | 40/50 | 130/140 |
| Area of contact with $2^{nd}$ GR ($mm^2$) | 6700 | 6200 | 5700 | 11000 | 3200 |
| Area of contact with $3^{rd}$ GR ($mm^2$) | 15500 | 14500 | 13500 | 20500 | 12000 |
| Total draw ratio | 6.40 | 6.44 | 6.48 | 6.00 | 6.30 |
| Denier | 1010 | 1004 | 1018 | 1013 | 1016 |

TABLE 4

| Condition | Example 10 | Example 11 | Example 12 | Comp. Ex. 7 | Comp. Ex. 8 |
|---|---|---|---|---|---|
| Temperature of melt polymer (° C.) | 296 | 297 | 298 | 299 | 320 |
| Temperature of polymer in gear pump (° C.) | 310 | 310 | 310 | 300 | 315 |
| Length of hood heater (mm) | 320 | 380 | 400 | 250 | 550 |
| Temperature of hood heater (° C.) | 350 | 375 | 400 | 320 | 440 |
| Pressure of quenching air (mmAq) | 90/100 | 110/120 | 110/120 | 40/50 | 130/140 |
| Area of contact with $2^{nd}$ GR ($mm^2$) | 7000 | 6500 | 5900 | 11500 | 3600 |
| Area of contact with $3^{rd}$ GR ($mm^2$) | 16000 | 15000 | 14000 | 21000 | 12500 |
| Total draw ratio | 6.30 | 6.35 | 6.4 | 5.85 | 6.15 |
| Denier | 1010 | 1004 | 1018 | 1013 | 1016 |

TABLE 5

| | Drawn Yarn | | | Monofilament | | | | |
|---|---|---|---|---|---|---|---|---|
| | Appearance (presence or absence of fluff or loop) | Number of fluffs (entities/ 30,000 meter) | Processability (yarn breaking entities/ Day × position) | Tenacity (g/d) | Elongation at break (%) | Elongation at 2.0 g/d (%) | Elongation under stress of 2.0 g/d to 9.0 g/d (%) | Elongation under stress of 10.0 g/d to break point (%) |
| Ex. 1 | 0 | 0 | 0.5 | 11.16 | 12.8 | 2.0 | 6.7 | 2.6 |
| Ex. 2 | 0 | 0 | 1.2 | 11.55 | 12.1 | 1.9 | 6.5 | 2.7 |
| Ex. 3 | 0 | 0 | 1.3 | 11.90 | 11.7 | 1.9 | 6.0 | 3.1 |
| Ex. 4 | 0 | 0 | 0.9 | 11.33 | 12.3 | 1.7 | 6.6 | 2.4 |
| Ex. 5 | 0 | 1 | 1.5 | 11.68 | 11.6 | 1.8 | 6.1 | 2.8 |
| Ex. 6 | 0 | 1 | 1.6 | 12.08 | 11.1 | 1.7 | 5.8 | 2.9 |
| Ex. 7 | 0 | 0 | 0.5 | 11.78 | 13.2 | 2.1 | 5.9 | 4.0 |
| Ex. 8 | 0 | 0 | 0.8 | 11.90 | 12.6 | 1.8 | 5.7 | 4.4 |
| Ex. 9 | 0 | 0 | 0.9 | 12.33 | 11.9 | 1.7 | 5.7 | 4.4 |
| Ex. 10 | 0 | 0 | 0.9 | 11.69 | 13.1 | 2.0 | 5.9 | 4.3 |
| Ex. 11 | 0 | 0 | 1.3 | 11.98 | 12.3 | 1.8 | 5.6 | 4.7 |
| Ex. 12 | 0 | 1 | 1.5 | 12.45 | 11.9 | 1.7 | 5.6 | 4.4 |
| Comp. Ex. 1 | 6 | 20 or more | 3.5 | 10.17 | 17.0 | 2.8 | 10.3 | 0.5 |
| Comp. Ex. 2 | 4 | 7 | 2.8 | 10.90 | 15.2 | 2.6 | 7.9 | 1.1 |
| Comp. Ex. 3 | 20 or more | 20 or more | 3.2 | 10.22 | 16.4 | 2.5 | 8.8 | 0.5 |
| Comp. Ex. 4 | 9 | 11 | 2.7 | 10.89 | 15.6 | 2.4 | 7.9 | 1.0 |
| Comp. Ex. 5 | 3 | 9 | 3.7 | 9.82 | 17.1 | 2.7 | 10.8 | 0 |
| Comp. Ex. 6 | 2 | 5 | 3.2 | 10.33 | 15.8 | 2.4 | 8.2 | 0.9 |
| Comp. Ex. 7 | 5 | 20 or more | 4.3 | 9.98 | 17.0 | 2.5 | 10.4 | 0 |
| Comp. Ex. 8 | 2 | 6 | 3.1 | 10.43 | 15.9 | 2.3 | 7.8 | 1.2 |

The present invention is effective in maintaining the intrinsic properties of polyethylene terephthalate chip as much as possible, and in allowing excellent spinnability by optimizing the spinning conditions, thus suppressing generation of fluffs. The invention can provide an industrial high tenacity polyethylene terephthalate yarn having high modulus, high tenacity and low elongation at break due to high ratio drawing, which is useful for industrial rope, reinforcement material for construction, webbing, seatbelt and the like.

What is claimed is:

1. A process for preparing a polyethylene terephthalate monofilament comprising the steps of:

spinning a polyethylene terephthalate chip having an intrinsic viscosity of 0.8 to 1.3 through a nozzle having 192~384 orifices, passing the spun yarn from the nozzle through a hood heater adjusted to 350~400° C. and extended to 320~500 mm, quenching the yarn from the hood heater, oiling the quenched yarn, and drawing in a multistep process using a plurality of godet rollers on which the contact areas between the yarn and the second godet rollers for the primary drawing is adjusted to 4,000~8,000 $mm^2$ and the contact areas between the yarn and the third godet rollers is adjusted to 14,000~18,000 $mm^2$ for the secondary drawing, wherein the contact area is determined by the following equation:

$$\text{contact area} = \text{average yarn width} \times \text{number of turns} \times \text{radius of godet rollers} \times 2,$$

wherein the polyethylene terephthalate monofilament so produced gives a stress-strain curve exhibiting an elongation of less than 2.5% at an initial stress of 2.0 g/d, with an initial modulus value of 80 to 160 g/d, an elongation of 7.5% or less in a stress range of from 2.0 g/d to 9.0 g/d, and an elongation of at least 2.0% or more in a stress range of from 10.0 g/d to the point of break.

2. The process according to claim 1, wherein the linear density of the polyethylene terephthalate is 3 to 30 denier.

* * * * *